US005967656A

United States Patent [19]

Andersson et al.

[11] Patent Number: 5,967,656

[45] Date of Patent: Oct. 19, 1999

[54] METHOD AND APPARATUS FOR HOMOGENIZING OF BULK MATERIAL

[75] Inventors: Conny Andersson; Lars-Åke Fredriksson, both of Kil, Sweden

[73] Assignee: Dynapac International Aktiebolag, Malmo, Sweden

[21] Appl. No.: 08/981,034

[22] PCT Filed: May 31, 1996

[86] PCT No.: PCT/SE96/00706

§ 371 Date: Dec. 9, 1997

§ 102(e) Date: Dec. 9, 1997

[87] PCT Pub. No.: WO97/00124

PCT Pub. Date: Jan. 3, 1997

[30] Foreign Application Priority Data

Jun. 16, 1995 [SE] Sweden ..... 9502186

[51] Int. Cl.[6] ..... B01F 15/02

[52] U.S. Cl. ..... 366/131; 366/153.1; 366/186

[58] Field of Search ..... 366/186, 152.6, 366/153.1, 266, 292, 318, 323, 132, 133, 131, 150.1

[56] References Cited

U.S. PATENT DOCUMENTS

| | | | |
|---|---|---|---|
| 4,201,484 | 5/1980 | Sasiela et al. | 366/153.1 |
| 4,449,908 | 5/1984 | Campbell | 366/323 |
| 4,559,104 | 12/1985 | Eriksson | 366/323 |
| 4,710,032 | 12/1987 | Nordlund | 366/186 |
| 5,052,874 | 10/1991 | Johanson | 366/323 |

FOREIGN PATENT DOCUMENTS 466 101 12/1991 Sweden .

*Primary Examiner*—Tony G. Soohoo
*Attorney, Agent, or Firm*—Griffin, Butler, Whisenhunt & Szipl, LLP

[57] ABSTRACT

The invention relates to a method and an apparatus for homogenizing bulk material, wherein the bulk material is supplied from above into a container which is restricted sidewards and downwards and is fed out by means of a feeding out conveyor located in the lower portion of the container. The characteristic features of the invention are that the bulk material is fed in from above in one end of the container (20), wherein the bulk material is caused to slide down towards the opposite end of the container such that a bed of bulk material is formed having a sloping profile in the container, and wherein, due to the sliding, heavier and/or coarser fractions of the bulk material slides more than lighter fractions, and that during each time unit a volume of bulk material is fed out from the bottom portion of the container from each section (Δl) of the length of the container in the feeding out direction, said volume of bulk material corresponding to the supply of bulk material during the same time unit to the section ($A_n$) of the upper surface of the bed lying straight above said section of the length of the container, wherein the bulk material is caused to move essentially downwards in the bed along the entire length of the bed towards said outfeeder (30) which feeds out the material from each section at essentially the same rate as new material is supplied to the above lying surface section of the upper surface of the bed.

23 Claims, 4 Drawing Sheets

METHOD AND APPARATUS FOR HOMOGENIZING OF BULK MATERIAL

TECHNICAL FIELD

The invention relates to a method and an apparatus for homogenizing bulk material, comprising a container having a rear end wall and a front end wall and two side walls, a feeding in conveyor for feeding in bulk material from above into the container, which is provided to accommodate a bed of bulk material, the extension of said bed being limited by the end walls and the side walls; and a feeding out conveyor at the lower part of the container, said feeding out conveyor extending at least between the end walls and being exposed against the bulk material between the two end walls and provided to feed out the bulk material in a direction towards the front end wall.

BACKGROUND OF THE INVENTION

Bulk material containing solid particles usually has a varying particle size distribution and/or mass distribution.

In the handling of such bulk material, which may consist e.g. of gravel, sand, asphalt or gravel mixtures, asphalt-concrete, moist concrete, or the like, the bulk material usually is separated into fractions containing coarser and finer particles. When a container is being filled with that type of bulk material by supply from above, e.g. from a point, the bulk material will form slope sides in the container along which coarser and/or heavier particles will fall down and collect at the foot of the slope to a greater degree than finer and/or lighter particles will do. This separation process occurs if the bulk material has a dry consistency, such as gravel, but also in the case of moist bulk material, such as wet cement-concrete wherein coarser and/or heavier particles will drop to the bottom of the container to form slopes in a corresponding way. This will cause a separation inside the container into regions containing coarser and/or heavier particles and regions containing finer and/or lighter particles, but the sizes of these regions will depend on variations in composition of the supplied bulk material. During the feeding out of the bulk material from the container by means of continuously working conveyors, such as worm conveyors, endless conveyor belts, continuously working scraper conveyors, tube conveyors and the like, the size and/or mass distribution of the particles will vary in the fed out material. For example, at the feeding out of asphalt mixtures for road surfacing one has observed a separation of the particle shaped material into coarser and finer fraction, in the road surface, which has led to impaired wear resistance due to the fact that a certain size fraction may be missing while an other one may exist in excess although the material which was supplied had a proper particle size distribution.

BRIEF DISCLOSURE OF THE INVENTION

The overall purpose of the invention is to solve the above mentioned problem. The invention herein takes advantage of the observation that, when a bulk material is supplied from above to a container from essentially a point, or possibly along a line, the bulk material will be fractioned in the container in the above mentioned way, which means that a supply of bulk material having a certain particle size and/or mass distribution, or a supply of bulk material having a particle size and/or mass distribution varying over time, to a certain degree will be fractioned in a predictable way according to its particle size and/or mass distribution. This observation is taken advantage of according to the invention in that the feeding out conveyor is dimensioned and designed such that it will feed out the bulk material with a volume per time unit and length unit of the feeding out conveyor adapted to the fractioning which did occur in the container, with the result that the fed out bulk material will achieve a particle size distribution corresponding to that of the bulk material which was fed in, and the same time as the particle size distribution will be homogenized, utilizing the previous fractioning in the container known by experience.

More particularly, the above is achieved according to the invention in that the feeding out conveyor is designed such that the volume of bulk material which is fed out per length unit of the conveyor increases along the length of the conveyor from the rear end wall to the front end wall, wherein the increase of the volume of bulk material which is fed out per said length unit in the direction of transportation is proportional to the surface within the corresponding length unit of the upper surface of the bed of bulk material between the end walls and the side walls at equilibrium when the feeding in of bulk material into the conveyor equals the feeding out of bulk material.

Further characteristic features, aspects and advantages of the invention will be apparent from the following description of a preferred embodiment, and from the appending claims.

BRIEF DESCRIPTION OF DRAWINGS

In the following description of a preferred embodiment will be made in reference to the accompanying drawings, in which FIG. 1 schematically shows a container having a feeding out conveyor, where the principles of the invention can be implemented.

DETAILED DESCRIPTION OF THE INVENTION

Figure 1:
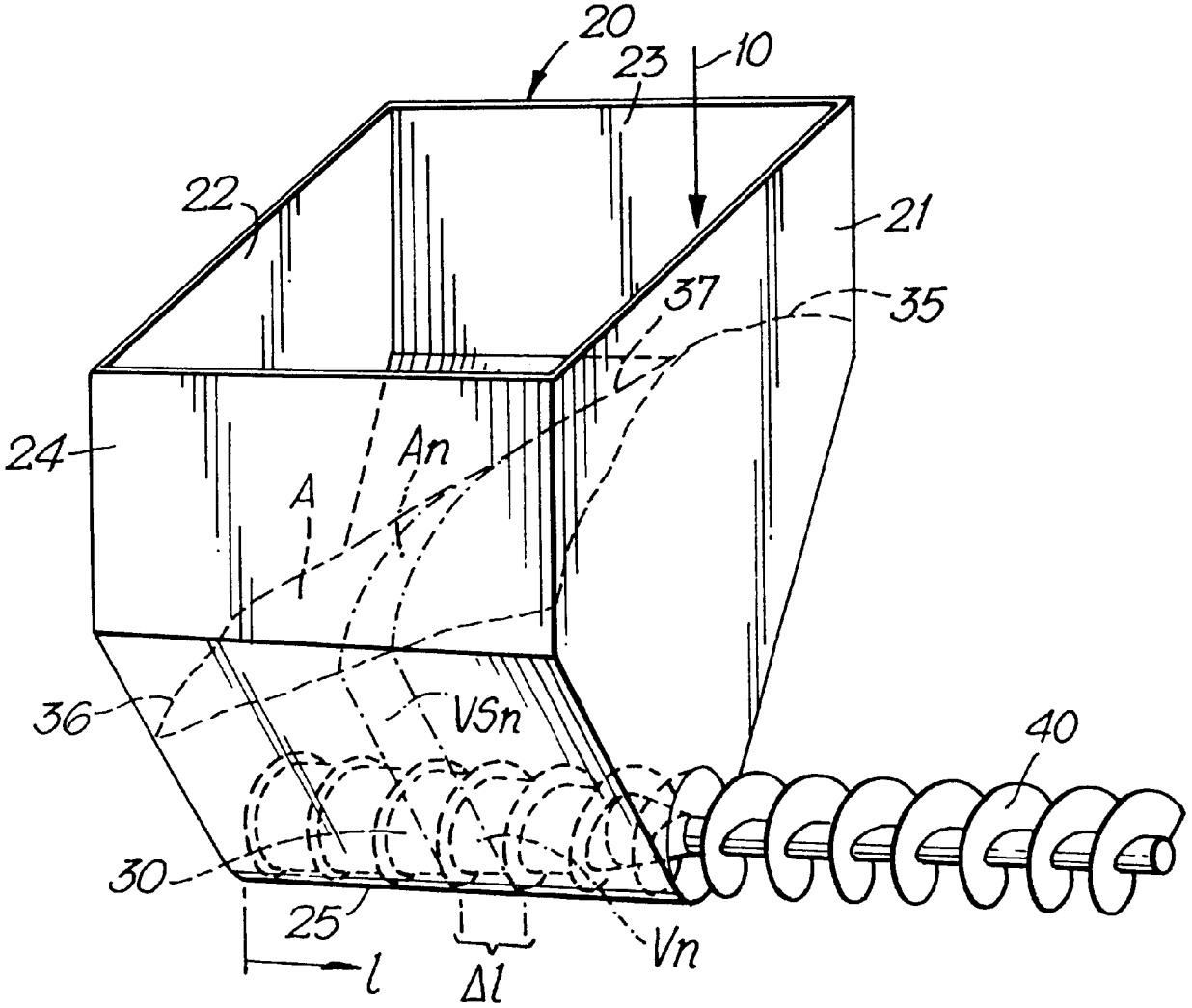

With reference first to FIG. 1, a container is generally designated 20. It consists of a front end wall 21, which is vertical, a rear end wall 22, which also is vertical, and two side walls 23, 24, which have an upper vertical portion and which therebeneath slope downwards/inwards in the region of a bottom portion 25.

In the bottom portion 25 there is a feeding out conveyor 30, which in the preferred embodiment consists of a worm screw conveyor, which along part of its length extends between the two vertical end walls 21, 22. In that area, the feeding out screw 30 is exposed to the bulk material accomodated in container 20. The feeding out screw 30 is extended beyond the container 20 but that part of the screw is designed as a conventional worm conveyor 40.

Bulk material is supplied to container 20 from above by means of a feeding in conveyor which symbolically is indicated by arrow 10. According to the invention, the bulk material is supplied by means of the feeding in conveyor 10 adjacent the front end wall 21. The bulk material has varying particle sizes and/or particles densities, which bring about that the larger and/or heavier particles roll down along the sides of the pile 35 of bulk material which successively is formed in the container 20. The coarsest and/or heaviest material therefore collects at the foot 36 of the slope near the rear end wall 22 while the finest and/or lightest material to a major degree stays on top 37. At equilibrium the material is fed out by means of the worm screw conveyor 30 at the same rate as it is being supplied by the feeding in conveyor 10.

The purpose with the apparatus is that the bulk material which is fed out from the container 20 shall have a substantially improved homogenity as compared to that which it has in container 20 and preferably even a better homogeneity than it had when it was supplied by means of the feeding in conveyor 10. According to the invention, the material is allowed to roll or slide down as above described to cause a separation. Since the side walls slope inwards, the distance between these walls in the region of the upper surface of the bed of bulk material will continuously be smaller from the front end wall to the rear end wall because of the sloping pile shape, such that the upper surface of the bed of bulk material will get the shape of a wedge when viewed from above. Since the material rolls or slides down also towards the side walls, the slope will get a rounded shape, and if the upper surface of the bed of bulk material was flattened out it would get the shape shown by the dashed line in FIG. 1. This line can be approximized with a straight line wherein a surface according to the continuous line in FIG. 2 is achieved.

Figure 2:
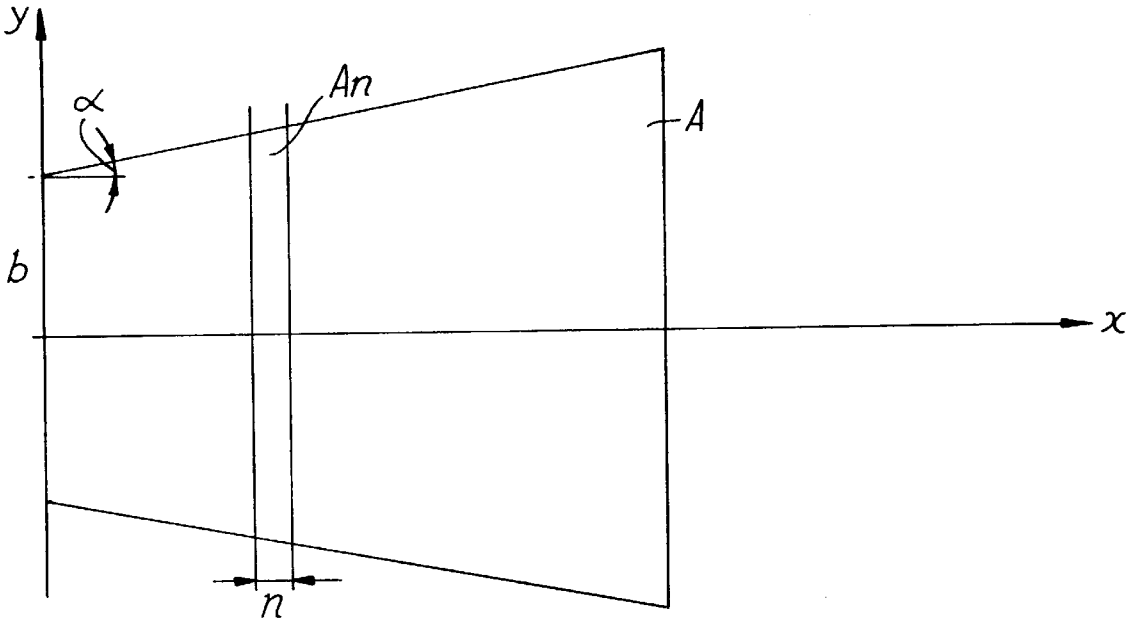
FIG. 2 shows the upper surface of the bulk material placed in a system of coordinates.

Without binding the invention to the theories which shall be explained in the following, it is the opinion of the applicant that there is a relationship between the upper surface of the bed of bulk material and the volume of the worm conveyor, in that the increase of fed out volume of bulk material $\Delta V_n$ per length unit n in the direction of transportation of the worm is proportional to the surface $A_n$ of the upper surface A of the pile 35 of bulk material between the end walls and the side walls within the corresponding length unit n, wherein $V_n$ corresponds to the volume in the worm within the length unit n. Thus there is a functional relationship $V_n=f(l)$, where l is the extension of the feeding out conveyor 30 in the direction of transportation. The upper surface of the bulk material can be calculated according to the following:

A system of coordinates is applied to the surface according to FIG. 2, wherein the line along one of the long sides of the container can be expressed as: y=kx+b, where k is the inclination of the line, i.e. tan y/x, and b is half the breadth of the line of contact of the surface to the rear end wall 22.

The area A above the x-axis can be expressed as:

$$\int(kx+b)dx \text{ and over the entire surface } 2\int(kx+b)dx=[kx^2+2bx]$$

Since the increase of volume within any length unit according to the above discussion is proportional to the upper surface for the same length unit it is thus derived that $\Delta V_n=Ka_n$ and thus that $$\Delta V_n=K[kx^2+2bx]_x^{x+n}$$

where K is a constant which can be calculated empirically and depends on the dimensions of the container, its design, fill degree and type of bulk material, which factors also the constants k and b are dependent of. The expression therefore can be simplified to $$\Delta V_n=[K_1x^2+K_2x]_x^{x+n}$$

From a practical point of view one can, according to the above, state that the increase of worm volume is an exponential function—a concave function—of the extension of the worm conveyor in the direction of transportation for a container defining an upper surface as above. Further it is known that the slide angle of the bulk material lies in the range 35°±5° and with a known design of the container a good starting value for the empirical calculations can be made. The worm volume of the conveyor worm thus can be calculated by increasing the worm volume from a start value according to the expression $V_n=V_{n+1}+\Delta V_n$.

Due to the fact that the worm is designed such that the worm volume increases towards the feeding out opening according to the expression above, an equalisation of the material and a homogenisation of the fractions will occur, i.e. the material in the bed will move essentially vertically downwards in the bed. If the worm were not designed in accordance to the above description, for example if it had a constant worm volume along its entire length, there would, according to the above theories, and according to experiments carried out in practice, be taken out more material at the rear end wall wherein the slope would be steeper and a more and more increased slide would occur, with the result that predominantly coarser fractions would be fed out.

According to the above discussion, in order to achieve an equalisation of the fed out material, the worm increase would be represented by a convex function, when the feeding in conveyor instead would feed in the bulk material adjacent to the rear end wall 22, i.e. the worm volume increase would be reduced in the transport direction according 30 to the inverse to the above given function for $\Delta V_n$.

Presuming that the walls of the container are not inclined inwards, but are substantially parallel, the top surface of the bulk material is essentially rectangular, and according to the above discussion the feeding out worm thus should be designed to have a linear increase of the worm volume. An embodiment of that type could be conceived if the bottom surface of the container was provided with a number of parallel feeding out worms which covered the major part of the container bottom.

The above can be achieved with various designs of the transport worm 30; wherein that the outer diameter D of the worm is constant, while the diameter d of the worm core is getting smaller in the transport direction of the worm; wherein that the outer diameter of the worm is increased in the transport direction of the worm while the diameter d of the worm core is constant; and/or wherein that the outer diameter D of the worm and the outer diameter d of the worm core are constant, while the increase of the fed out volume of bulk material per length unit Δl is achieved through a corresponding increase of the pitch angle α of the conveyor worm (conveyor screw) in the direction of transportation.

Figure 3:
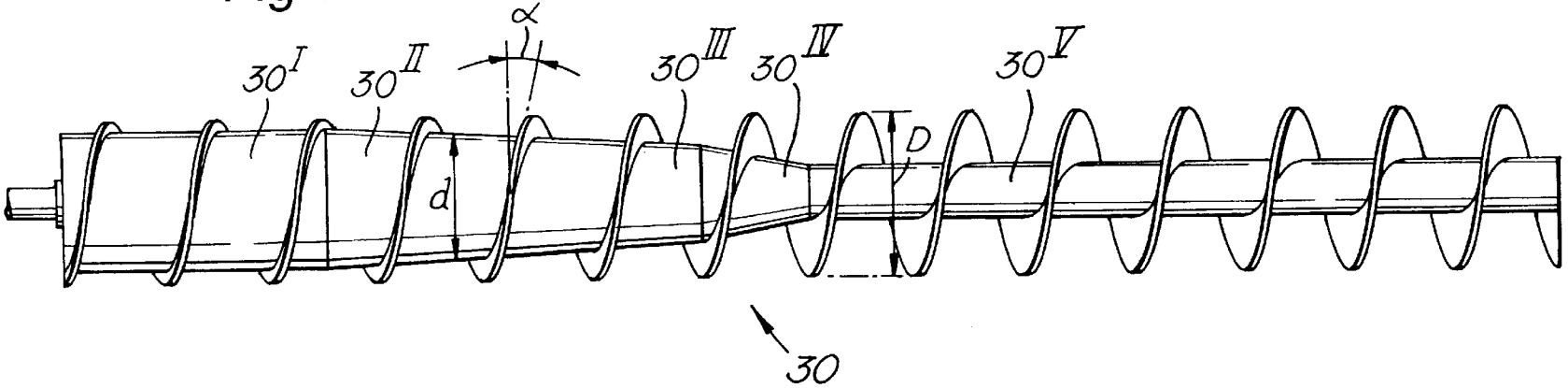
FIG. 3 shows a conceivable embodiment of a feeding out conveyor.

A preferred embodiment of the conveyor worm 30 is shown in FIG. 3. According to this figure the outer diameter D and the pitch angle α of the worm is constant, while the outer diameter d of the worm (screw) core gets smaller. An approximation of the ideal worm increase has been made by constructing the worm (screw) core by means of sections $\mathbf{30}^{I-V}$ which either are cylindrical or conical with different, successively increasing conicity in the direction towards that end of the container where the bulk material is supplied, i.e. according to the embodiment in the direction towards the feeding out end. The shown conveyor worm consists of five sections, wherein the last section $\mathbf{30}^{V}$ is located outside the container and intended to transport the bulk material further on. This provision facilitates the manufacturing of the screw, such that it adopts a shape which approximately corresponds to the ideal one, wherein a sufficient function is achieved.

Figure 4:
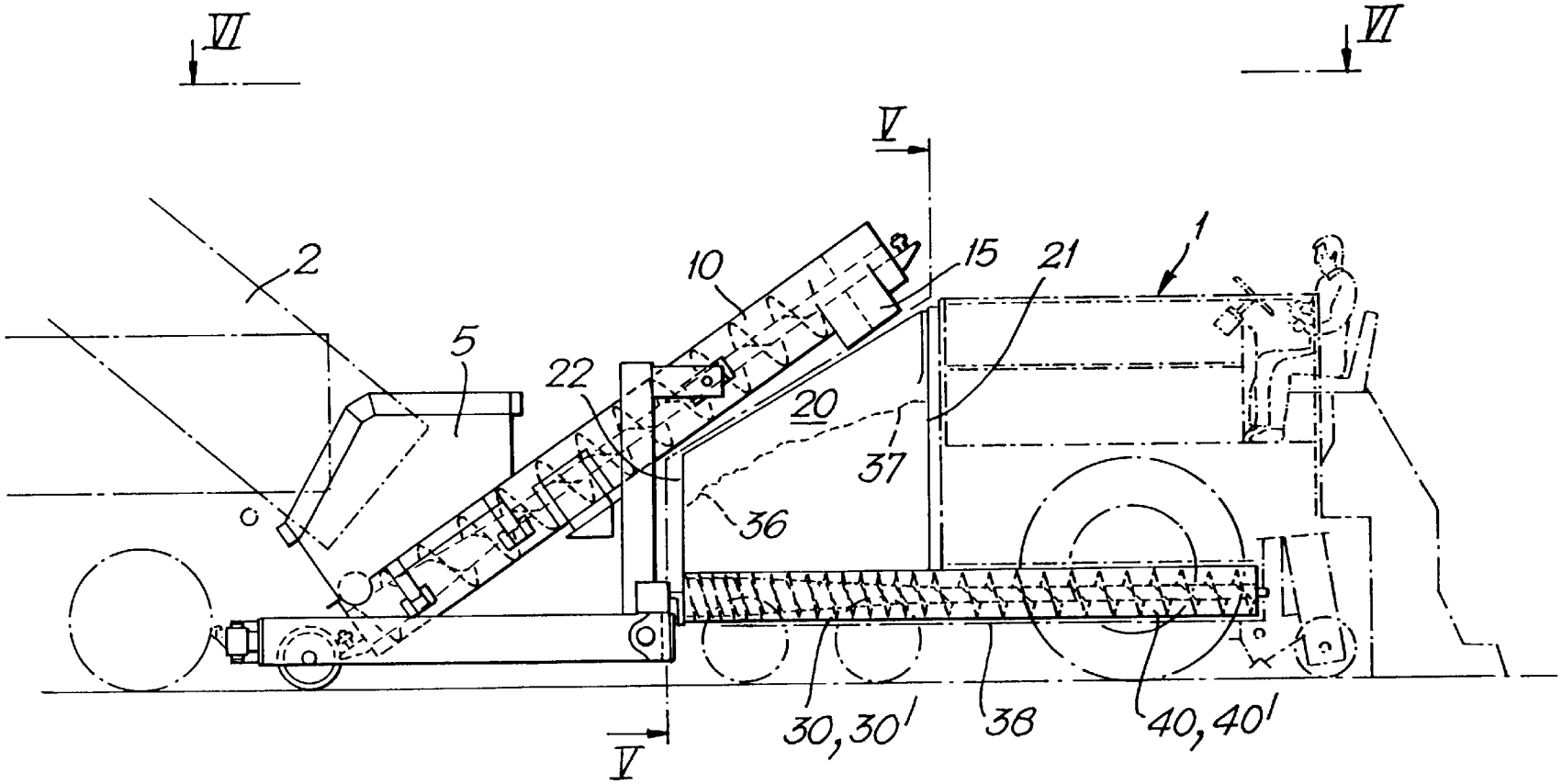
FIG. 4 is a side view of a an asphalt surfacing machine to which there is connected an apparatus according to a preferred embodiment of the invention.
Figure 5:
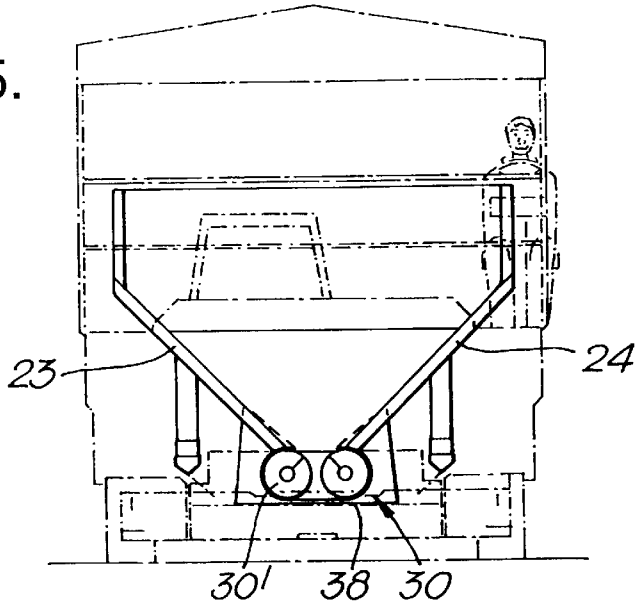
FIG. 5 shows a view along the line V—V in FIG. 4.
Figure 6:
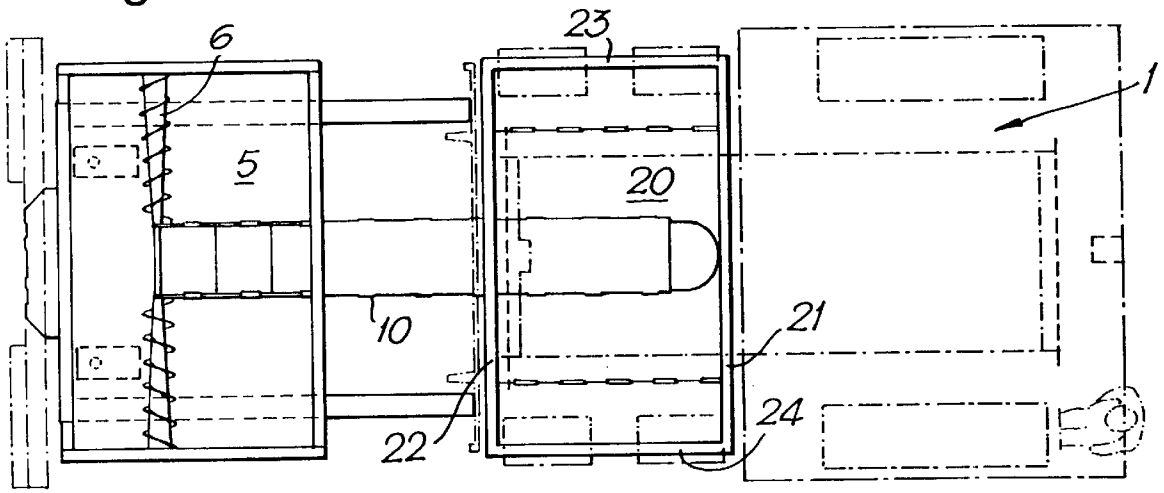
FIG. 6 is a view VI—VI in FIG. 4.

In that embodiment of the apparatus for homogenizing bulk material according to the invention which is shown in FIGS. 4–6, it consists of a mobile asphalt surfacing machine 1. Details in the apparatus which have correspondence in FIG. 1 have been given the same reference numerals as in FIG. 1.

The apparatus includes a primary container 5 provided with a transverse feed worm 6; a feeding in conveyor 10; a container 20; two parallel feeding out worms 30 and 30' which via extensions 40, 40' are connected to a transverse distribution worm (not shown) for applying asphalt material on a road surface. The primary container 5 is a container which, when full, accommodates about 1 ton of asphalt material, provided for filling from a lorry platform 2. The transverse feed worm 6 has an increasing worm volume in the direction of transportation as well as the in feeder 10 which likewise has an increasing worm volume in the direction of transportation in that part which is located in the region of the primary container 5 in accordance with the principles of the invention described in the foregoing. The feeding in worm 10 has its outlet opening 15 at the substantially vertical end wall 21 of container 20, which is located foremost forwards as seen in the direction of transportation of the feeding out worms 30 and 30'. The container 20, which has a volume of about 2.5 $m^3$, has two substantially vertical, opposite end walls 21, 22 perpendicularly to the feeding out direction of the feeding out worms 30 and 30', and to longitudinal side walls 23, 24 which partly slope inwards. The rear end wall 22 is substantially longer than the front end wall 21, and the upper edge of the side walls 23, 24 slope from the front end wall 21 rearwards towards the rear wall 22. The container has in its bottom portion a rectangular horizontal section which decreases downwards, said section having a constant length in the feeding out direction of the bulk material. The feeding out worms 30 and 30' are congruently dimensioned, but one of them is left hand thread and the other one is right hand thread and they have opposite directions of rotation. They are provided to rotate in a feeding out chamber 38 beneath the bottom portion by means of driving means which are not shown.

The mobile asphalt surfacing machine 1 is moved on a road surface during asphalt surfacing. The primary container 5 is filled from a lorry in front of the asphalt surfacing machine, wherein the lorry discharges the asphalt material from its platform 2 down into the primary container 5. The primary container 5 also serves as an intermediate store when a lorry has been emptied and before a new one has been connected to the machine. The asphalt material is supplied to container 20 from the primary container 5 by means of the transverse conveyor worm 6 and the in-feeder conveyor 10, both of them being dimensioned with increasing worm volume in order to smooth out the fractioning of the bulk material on the lorry platform 2 and in the primary container 5 in accordance with the principles of the invention explained in the foregoing. The feeding in conveyor 10 extends from the bottom portion of the primary container parallel with the upper edges of the side walls of the subsequent container 20 and the material is delivered in the container 20 adjacent the front wall 21 continuously and substantially at the same rate as the asphalt material is fed out from the container 20 by means of the feeding out worms 30 and 30'. The extensions of the feeding out worms 30 and 30' are conventional worm conveyors 40 and 40' which feed the asphalt material forwards to a transverse distribution worm which is not shown but which has to the object to distribute the asphalt material over the breadth of that part of the road surface which shall be surfaced.

The asphalt material in container 20 has a level such that the entire feeding out worms 30 and 30' are covered with asphalt material. At equilibrium between supplying asphalt to and discharging asphalt from container 20, the asphalt material will form a pile having different particle size and/or particle mass distribution in different parts of the pile. Through the design of the feeding out worms 30 and 30' according to the invention, the feeding out worms 30 and 30' bring away a predetermined volume per length unit and time unit in proportion to the surface area of the bed of bulk material lying above the length unit in the container 20. The bulk material within each vertical volume segment of the bed of bulk material, such as the volume segment $Vs_n$ lying under the surface An, will successively sink essentially vertically down towards the feeding out conveyor. This can be expressed such that the bulk material within each part of the bed of bulk material in the container, through the method and the apparatus according to the invention, will sink from the upper surface essentially vertical downwards towards the feeding out conveyor, which feeds out the material from each segment at the same rate as new material is supplied to the above lying surface segment of the surface of the bed.

It should be understood from the above description that the worm volume increase is not necessarily achieved by one worm (screw). What is important is that the bulk material in all parts of the container is fed/sinks essentially vertically downwards because of the desired increase of volume of the worm. How this is achieved, by one or several worms, or by other types of feeding out means, is not essential.

A number of advantages are achieved by the apparatus of the invention. Rather than necessarily avoiding the separation into fractions, which almost always occurs when feeding out bulk material at any spot, the fact that separation occurs is utilized for the achievement of a good equalization and homogenizing of the bulk material. The apparatus and its principles can be utilized for in principle all sorts of bulk material, such as sand materials, gravel, stones, asphalt-concrete, and the like. It shall therefore be understood that the invention is not restricted to the embodiment described above and shown in the drawings but can be modified within the frame of the appending claims.

We claim:

1. In a method for homogenizing particulate bulk material comprising: feeding in the bulk material into a container (20) having a rear end wall (22), a front end wall (21) and two side walls (23, 24), said feeding in being from above and close to one of said end walls so that the bulk material is caused to slide downwardly towards an other of said end walls such that a bed of bulk material is formed in the container that has a sloping profile and heavier and/or coarser factions of the bulk material slides further along the profile than lighter fractions; and feeding out the bulk material from a bottom portion of the container by means of a conveyor (30, 30') which has a length extending from at least the rear end wall to the front end wall and being exposed to the bulk material in the container so that the feeding out is in a feeding direction towards the front end wall;

the improvement wherein the feeding out is performed by a feeding out conveyor having means for conveying volumes of bulk material per length unit (n) of the conveyor which increase in the feeding direction proportionally to discrete surfaces ($A_n$) of the upper surface (A) corresponding to length units (n) of the feeding out conveyor vertically thereunder so that the bulk material is caused to move essentially downwardly in the bed of bulk material when the feeding in and feeding out of the bulk material is at equilibrium.

2. Method according to claim 1, wherein the bulk material is fed out from the container in a substantially horizontal direction.

3. Method according to claim 1, wherein the bulk material is fed out in the same end of the container as where the bulk material is supplied.

4. In an apparatus for homogenizing particulate bulk material, comprising a container (20) having: a rear end wall (22); a front end wall (21) and two side walls (23, 24); a feeding in conveyor (10) for feeding in the bulk material from above and into the container to provide in the container a bed of the bulk material having an upper surface (A) and which bed of bulk material extends from the rear wall to the front wall; and a feeding out conveyor (30, 30') at a lower part of the container which has a length extending at least from the rear end wall to the front end wall and being exposed to the bulk material in the container so as to provide a feeding out of the bulk material in a feeding direction towards the front end wall;

the improvement wherein the feeding out conveyor (30, 30') has means for conveying volumes of the bulk material per length unit (n) of the conveyor which increase in the feeding direction proportionally to discrete surfaces ($A_n$) of upper surface (A) corresponding to length units (n) of the feeding out conveyor vertically thereunder when the feeding in and feeding out of the bulk material is at equilibrium.

5. Apparatus according to claim 4, wherein at least a portion of the side walls slope inwards towards the feeding out conveyor (30, 30'), a feeding conveyor (10) is provided to feed in the bulk material into one end of the container adjacent to one of the end walls, and wherein the volume of bulk material ($\Delta V_n$) per length unit increases non-lineary in the feeding direction.

6. Apparatus according to claim 4, wherein the volume of bulk material increases according to an essentially exponential function in the feeding when the feeding in conveyor feeds in the bulk material adjacent to the front end wall and decreases essentially according to an inverse of the exponential function when the feeding in conveyor feeds in bulk material adjacent to the rear end wall.

7. Apparatus according to claim 4, wherein the increase of volume of bulk material ($\Delta V_n$) within any length unit (n) is proportional to the surface ($A_n$) within the corresponding length unit of the upper surface of the bulk material with constants ($K_1$, $K_2$) according to the formula $\Delta V_n=(K_1, K_2)A_n=[K_1x^2+K_2x]_x^{x+n}$, which constants are empirical units.

8. Apparatus according to claim 7, wherein the volume of bulk material ($V_n$) for any length unit (n) along the length (l) of the feeding out conveyor, is calculated according to $V_n=V_{n-1}+\Delta V_n$, starting from an initial value where l=0.

9. Apparatus according to claim 4, wherein the feeding out conveyor belongs to any of the types of continuously working conveyors which include worm conveyors, tube feeders, endless conveyor belts, continuously working scraper conveyors, and bucket conveyors.

10. Apparatus according to claim 9, wherein the feeding out conveyor comprises two or more worm conveyors working in parallel.

11. Apparatus according to claim 9, wherein worm volume(s) of the worm conveyor between the end walls of the container change in relation to a volume of bulk material in the container in such a way that, at equilibrium, when a supply of bulk material from the feeding in conveyor to the container is essentially the same as the feeding out of bulk material by means of the worm conveyor from the container, the worm volume increases in the feeding direction over any length unit (n) of the feeding out worm conveyor, in a degree which corresponds to said increase ($\Delta V_n$) of fed out volume of bulk material ($\Delta V_n$) per length unit.

12. Apparatus according to claim 9, wherein increased worm volume(s) of the worm conveyor is achieved by an outer diameter (D) of the worm conveyor being constant, while a diameter (d) of a worm core decrease in the feeding direction.

13. Apparatus according to claim 12, wherein the worm core consists of sections which are cylindrical and/or conical with different conicity to provide increase of volume ($\Delta V_n$) for each length unit (n).

14. Apparatus according to claim 9, wherein increased worm volume(s) of the worm (the transportation worms) conveyor is achieved by an outer diameter (D) of the worm conveyor increasing in the feeding direction of the worm conveyor, while a diameter (d) of a worm core is constant.

15. Apparatus according to claim 9, wherein an outer diameter (D) of the worm conveyor and an outer diameter (d) of a worm core are constant, while the increase of the volume of bulk material per length unit (Δ1) is achieved through an increase of a pitch angle of the worm conveyor (α) in the feeding direction.

16. Apparatus according to claim 4, wherein the end walls are vertical.

17. Apparatus according to any of claims 4, wherein an end wall adjacent to which the feeding in conveyor is higher than an opposite end wall.

18. Apparatus according to any of claims 4, wherein the apparatus also comprises a primary container (5) for bulk material, from which the feeding in conveyor collects the bulk material which it supplies to said container.

19. Apparatus according to claim 18, wherein the primary container (5) has a smaller volume than the said container (20).

20. Apparatus according to claim 18, wherein the feeding in conveyor is provided to feed the bulk material from a lower level out of the primary container (5) to a higher level above the subsequent container (20).

21. Apparatus according to claim 18, wherein the apparatus comprises the following units arranged after oneanother in series: the primary container, the feeding in conveyor, the said container, and the feeding out conveyor.

22. Apparatus according to claim 21, wherein the apparatus is connected to a asphalt surfacing machine.

23. Apparatus according to claim 22, wherein the feeding out conveyor extends beyond the front end wall all the way to said asphalt surfacing machine.

* * * * *